US010542811B2

(12) United States Patent
Befve et al.

(10) Patent No.: US 10,542,811 B2
(45) Date of Patent: Jan. 28, 2020

(54) APPLICATION PEN WITH AN INCLINED TIP END

(71) Applicant: L'OREAL, Paris (FR)

(72) Inventors: Denis Befve, Arras (FR); Eric Caulier, Ferrieres (FR); Pauline Prade, Saint Ouen (FR)

(73) Assignee: L'OREAL, Paris (FR)

( * ) Notice: Subject to any disclaimer, the term of this patent is extended or adjusted under 35 U.S.C. 154(b) by 73 days.

(21) Appl. No.: 15/578,818

(22) PCT Filed: May 26, 2016

(86) PCT No.: PCT/EP2016/061884

§ 371 (c)(1),
(2) Date: Dec. 1, 2017

(87) PCT Pub. No.: WO2016/193108

PCT Pub. Date: Dec. 8, 2016

(65) Prior Publication Data

US 2018/0213914 A1 Aug. 2, 2018

(30) Foreign Application Priority Data

Jun. 2, 2015 (EP) ..... 15305846

(51) Int. Cl.
*B43K 8/06* (2006.01)
*A45D 34/04* (2006.01)
*A45D 40/26* (2006.01)

(52) U.S. Cl.
CPC ..... *A45D 34/045* (2013.01); *A45D 40/265* (2013.01); *A45D 2200/1009* (2013.01);
(Continued)

(58) Field of Classification Search
CPC ..... A45D 34/04; A45D 40/26; A45D 2200/1009; A45D 2200/1018; A45D 2200/1072
(Continued)

(56) References Cited

U.S. PATENT DOCUMENTS 3,864,183 A 2/1975 Hori
6,328,040 B1 12/2001 Stein
(Continued)

FOREIGN PATENT DOCUMENTS

DE 20310911 U1 11/2003
DE 202016105503 U1 * 10/2016 ..... A45D 34/042
(Continued)

OTHER PUBLICATIONS

European Search Report dated Nov. 23, 2015 for counterpart European Application 15305846.6.

*Primary Examiner* — Jennifer C Chiang
(74) *Attorney, Agent, or Firm* — Polsinelli PC

(57) ABSTRACT

The invention relates to an application pen (10) for applying a fluid substance (S) on a body part, said application pen comprising an applicator head (12) made of a porous material (20), said applicator head comprising a first part (22) and a second part (24) inclined (α) relative to each other, said first and second parts being single-piece.

The applicator head is obtainable by a method comprising the following steps:

forming a rod made of the porous material, said rod extending parallel to the first axis and having a first transversal dimension; then removing a portion of porous material, by grinding, in an off-centered manner, from a segment of the rod, in order to reduce (27) the first transversal dimension of said segment, said segment including a junction (30) between the first and second parts.

19 Claims, 2 Drawing Sheets

(52) U.S. Cl.
CPC ..... *A45D 2200/1018* (2013.01); *A45D 2200/1072* (2013.01)

(58) Field of Classification Search
USPC ..... 401/130, 198
See application file for complete search history.

(56) References Cited

U.S. PATENT DOCUMENTS

| | | | | |
|---|---|---|---|---|
| 8,286,649 | B2 * | 10/2012 | Gueret | A45D 34/045 132/320 |
| 10,021,953 | B2 * | 7/2018 | Kudo | A45D 34/042 |
| 2007/0181143 | A1 * | 8/2007 | Montoli | A45D 40/262 132/320 |
| 2009/0269121 | A1 * | 10/2009 | Snedden | A61C 17/0202 401/183 |
| 2012/0207533 | A1 * | 8/2012 | Liu | B43K 8/003 401/262 |
| 2017/0238673 | A1 * | 8/2017 | Caulier | A45D 34/041 |
| 2017/0251786 | A1 * | 9/2017 | Kudo | A45D 34/042 |
| 2018/0020806 | A1 * | 1/2018 | Prade | A46B 9/021 401/196 |
| 2018/0140072 | A1 * | 5/2018 | Chen | A45D 34/04 |
| 2018/0146766 | A1 * | 5/2018 | Prade | A45D 40/20 |

FOREIGN PATENT DOCUMENTS

| | | | |
|---|---|---|---|
| JP | 3 088 420 | B1 | 9/2000 |
| JP | 2004 243 561 | A | 9/2004 |
| WO | WO-2014/019989 | A1 | 2/2014 |

* cited by examiner

APPLICATION PEN WITH AN INCLINED TIP END

CROSS REFERENCE TO RELATED APPLICATIONS

This application is a National Phase filing under 35 U.S.C. § 371 of PCT/EP2016/061884 filed on May 26, 2016; and this application claims priority to Application No. 15305846.6 filed in Europe on Jun. 2, 2015 under 35 U.S.C. § 119. The entire contents of each application are hereby incorporated by reference.

The present invention relates to an applicator head for applying a fluid substance on a body part, said applicator comprising an applicator head made of a porous material, said applicator head comprising a first part extending parallel to a first axis and a second part extending parallel to a second axis, said first and second axes being inclined relative to each other, said first and second parts being single-piece.

More specifically, the present invention relates to an applicator head for applying a cosmetic product, preferably a make-up composition, on a skin surface, preferably the skin of eyebrows.

A "cosmetic product" is in particular, in the meaning of the present invention, a product such as defined in EC Regulation N° 1223/2009 of the European Parliament and of the Council, dated Nov. 30, 2009, in relation with cosmetic products.

Examples of applicator heads for applying make-up on skin are known from EP1336353 and FR3007256.

Such applicator heads allow the drawing on skin of small lines, in order to mimic eyebrow hairs and to give a visual effect of thickened eyebrows, without unwantedly staining the skin.

However, such applicator heads imply dipping the application elements in a fluid cosmetic product before applying said elements on the skin. The dipping step, covering the whole head with product, may lead to imprecise application, unwanted stains or too thick lines.

It is known to avoid the dipping step by providing a felt-tip applicator, such as the application pen described in document US2009/0317423. However, a tip aligned with a principal axis of the application pen is unsuitable to a quick and easy make-up of the eyebrows.

An object of the present invention is to solve the problems described above. Accordingly, the present invention relates to an application pen such as mentioned above, obtainable by a method comprising the following steps: forming a rod made of the porous material, said rod extending parallel to the first axis and having a first transversal dimension; then removing a portion of porous material, in an off-centered manner, from a segment of the rod, in order to reduce the first transversal dimension of said segment, said segment including a junction between the first and second parts, said portion of porous material being removed by grinding.

According to preferred embodiments, the application pen comprises one or more of the following features, taken in isolation or according to any technical possible combination:

- the second part of the applicator head has a shape designed for the application of the fluid substance on a body part;
- the second part of the applicator head has a pointed shape, preferably a tapered shape;
- the porous material is chosen among a foam, a felt and a fibrous material;

- the application pen further comprises a container filled with an amount of the fluid substance, an end of the first part of the applicator head being in contact with the fluid substance;
- the application pen further comprises a longitudinal body extending parallel to the first axis, the applicator head being attached to an end of the longitudinal body, said longitudinal body encasing or being attached to the container;
- the fluid substance is a cosmetic composition, preferably a make-up composition.

The present invention also relates to a method for manufacturing such an application pen, including the formation of an application head through the following steps: forming a rod made of a porous material, said rod extending parallel to the first axis and having a first transversal dimension; then removing a portion of porous material from a segment of the rod, by grinding, in an off-centered manner, said segment including a junction between the first and second parts, the first transversal dimension of said segment being thereby reduced.

According to preferred embodiments, the method comprises one or more of the following features, taken in isolation or in combination:

- the rod of porous material is formed through the following steps: forming elongated rods by hot shaping, out of original yarns; then impregnating the elongated rods by a resin, then drying and curing said elongated rods; then cutting the elongated rods to an appropriate length;
- the method includes a further step of inserting the application head into a longitudinal body encasing a container filled with fluid substance.

The invention will be better understood, upon reading of the following description, taken solely as an example, in view of the appended drawings, in which.

Figure 1:
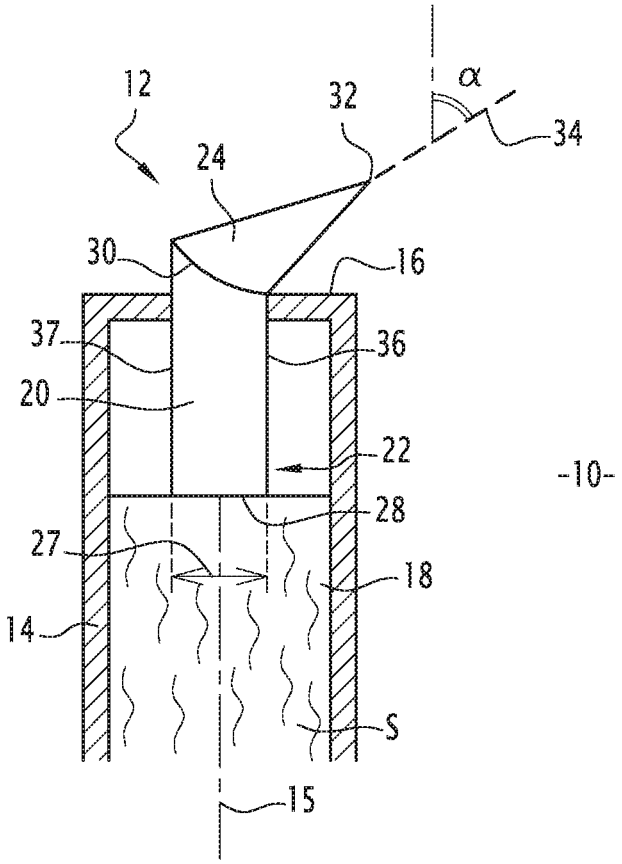
FIG. 1 is a side, partially cross-sectional view of an application pen according to an embodiment of the invention, comprising as applicator head.

FIG. 1 shows an application pen 10, according to an embodiment of the invention. The application pen 10 is designed for the application of a fluid substance, preferably a cosmetic composition, on a body part, preferably on a skin surface. In particular, the application pen 10 is designed for the application of a cosmetic composition, preferably make-up, on the skin of eyebrows.

The application pen 10 comprises an applicator head 12, intended to come into contact with the body part for the application of the fluid substance thereon. The application pen 10 also comprises a longitudinal body 14, extending along a first axis 15. An end 16 of said longitudinal body is attached to the applicator head 12. The longitudinal body 14 encases a container 18 filled with an amount of the fluid substance S, preferably of the cosmetic composition.

The fluid substance S, preferably the cosmetic composition, is more preferably a make-up composition, comprising colored or dark pigments. As an example, a suitable composition is an eye-liner composition, such as the composition of Art Liner® marketed by Lancôme.

The applicator head 12 is made of a first porous material 20, as will be detailed below. The applicator head 12 comprises a first part 22 and a second part 24, said first and second parts being single-piece.

The first part 22 has a substantially cylindrical shape, extending along the first axis 15. A base of the cylinder may be circular, oval, polygonal or irregularly shaped. In the embodiment of FIG. 1, the first part 22 has a circular base of a first diameter 27.

The first part 22 extends from a first end 28 of the applicator head 12 to a junction 30 between the first and second parts.

The second part 24 has a shape designed for the application of the fluid substance on a body part, preferably a pointed shape. In the embodiment of FIG. 1, the second part 24 has a conical shape, expanding from a second, pointed end 32 of the applicator head 12, to the junction 30 between the first and second parts. The cone extends along a second axis 34.

The first 15 and second 34 axes are coplanar and inclined relative to each other, forming an angle $\alpha$. Preferably, the angle $\alpha$ is comprised between 5° and 85°, more preferably between 20° and 50°.

An intersection of the applicator head 12 with a plane including the first and second axes 15, 34 forms two longitudinal edges 36, 37. A first, internal edge 36 is situated in the concavity of the elbow formed by the first and second parts 22, 24. A second, external edge 37 is situated in the convexity of the elbow formed by the first and second parts 22, 24.

The junction 30 between the first 22 and second 24 parts of the applicator head 12 has substantially the shape of a curved line resulting from the intersection of a cylinder and a cone, said cylinder and cone being inclined relative to each other.

The first end 28 of the first part 22 of the applicator head 12 is designed to be in contact with the fluid substance, preferably the cosmetic composition, so that capillary forces conduct a flow of fluid substance through the porous material 20 to the second end 32 of the second part 24. The pointed end 32 is then able to apply the fluid substance by contact with a body surface, preferably a skin surface.

Preferably, the first porous material 20 is chosen among a felt, a foamed material and a fibrous material such as a polyamide or a polyester. Preferably, the fibrous material is a soft resin for cosmetics.

The longitudinal body 14 is preferably made of a moldable, thermoplastic polymer such as polyethylene, polypropylene, polyester or polyamide.

The container 18 preferably comprises a block of a second porous material 40, impregnated with the fluid substance S. The second porous material 40 is preferably of a lower density than the first porous material 20. As shown on FIG. 1, the first end 28 of the applicator head 12 is in contact with the second porous material 40, so that the first part 22 is impregnated with the fluid substance S by capillarity.

A method for manufacturing the applicator head 12 will now be described, illustrated by FIGS. 2 and 3. As a first step, a rod 42 is formed out of the first porous material 20, for example by a method such as described below.

Figure 2:
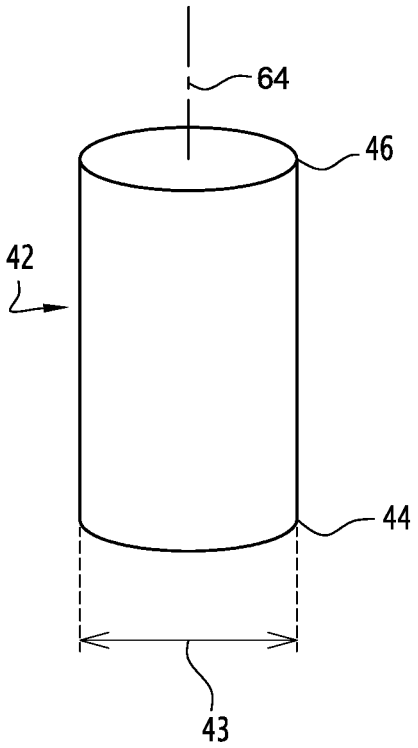
FIG. 2 is a perspective view of an intermediate product of a method for manufacturing the applicator head of FIG. 1.

As shown on FIG. 2, the rod 42 is cylindrical, extending along a third axis 64 parallel to the axis 15. The rod 42 has a circular base of a second diameter 43. The second diameter 43 is superior to the first diameter 27. A first end 44 of the rod 42 corresponds to the first end 28 of the applicator head 12. A second end 46 of the rod 42 corresponds to the second end 32.

Figure 3:
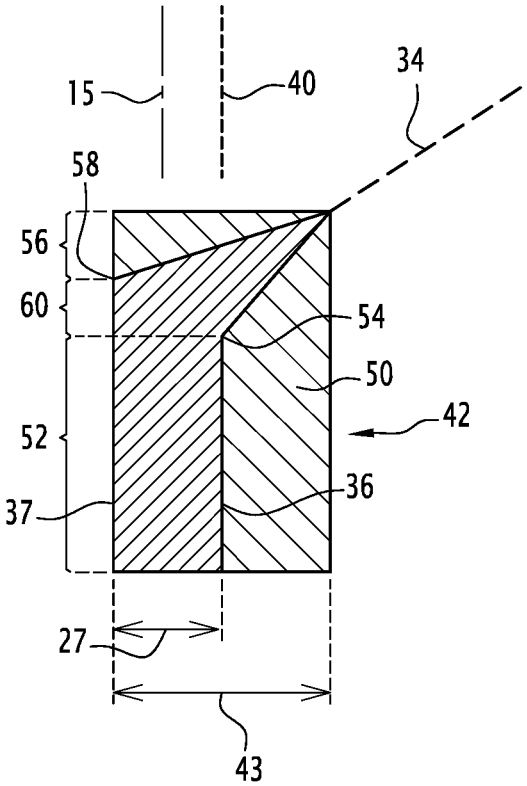
FIG. 3 is a cross-section view of the intermediate product of FIG. 2.

As a second step of the method for manufacturing the applicator head 12, an off-centered portion 50, shown on FIG. 3, is removed from the rod 42 in order to form the shape of the application head 12 as shown on FIG. 1.

The cross-section plan of FIG. 3 includes the first and second axes 15, 34. A first segment 52 of the rod 42 extends from the first end 44 to an inflexion 54 of the internal edge 36 of the application head 12. On the first segment 52, the off-centered portion 50 is comprised between two cylinders of respective diameters 27 and 43, said cylinders being tangent at the external edge 37.

More precisely, on the first segment 52 of the rod 42, a transversal section of the removed portion 50 is crescent-shaped, the tips of the crescent being on either side of the external edge 37. Said external edge 37 is situated on an external surface of the rod 42.

A second segment 56 of the rod 42 extends from the second end 46 to an inflexion 58 of the external edge 37. On the second segment, the removed portion 50 includes all the external surface of the rod 42, with the exception of the pointed end 32 of the second part 24.

On a third segment 60 of the rod, comprised between the first and second segments 52, 56, the removed portion 50 is complementary to the shape of the junction 30 between the first and second parts 22, 24 of the applicator head 12.

The off-centered portion 50 is removed by grinding. Preferably, the grinding is carried out with a mechanical machine having an abrasive disk turning at a speed of more than 1.000 turns per minute.

The resulting applicator head 12 has first and second parts 22, 24 inclined relative to each other without torsion stress in the material 20 of the junction 30.

The applicator head 12 is then inserted into a longitudinal body 14, in order to form an application pen 10.

Figure 4:
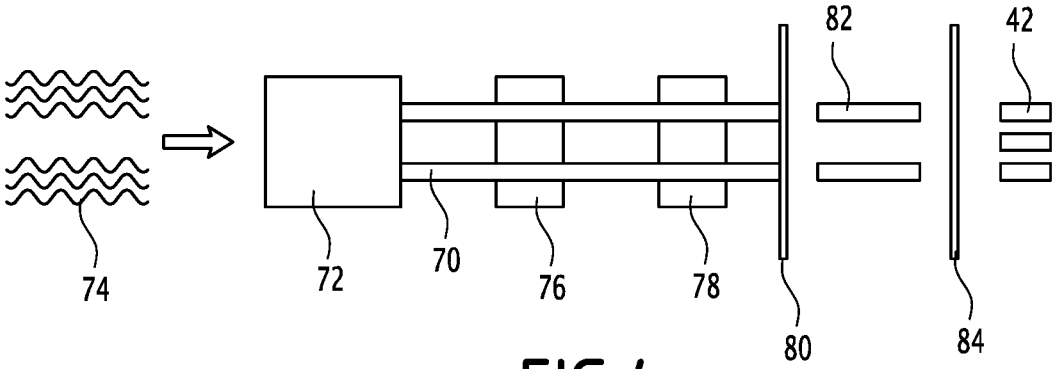
FIG. 4 is a schematic view of a method for manufacturing the intermediate product of FIGS. 2 and 3.

A method for manufacturing the rod 42 will now be described, illustrated by FIG. 4.

As a first step, elongated rods 70 are formed by hot shaping 72, out of original yarns 74. The elongated rods 70 are then impregnated with resin in a second step 76 and dried and cured in a third step 78. As a fourth step, the elongated rods are cut 80 into rough sticks 82, then the rough sticks 82 are cut 84 to the appropriate length into the rods 42 of FIGS. 2 and 3.

A method for the use of the application pen 10 will now be described, the fluid substance S being a make-up composition with dark pigments. A user seizes the longitudinal body 14, in order to place the pointed, second end 32 of the applicator head 12 in contact with his/her skin, preferably on one of his/her eyebrow. As the first end 28 of the applicator head 12 is in contact with the container 18 of fluid substance S, the second end 32 is impregnated with said substance by capillarity. Therefore, as the user moves the pointed, second end 32 along his/her eyebrow, a trace of make-up is left on the skin of the user.

The invention claimed is:

1. A method for manufacturing an application pen for applying a fluid substance on a body part, said application pen comprising an applicator head made of a porous material, said applicator head comprising a first part extending parallel to a first axis and a second part extending parallel to a second axis, said first and second axes being inclined relative to each other, said first and second parts being single-piece, said method including the formation of an application head through the following steps:

forming a rod made of a porous material, said rod extending parallel to the first axis and having a first transversal dimension; then removing a portion of porous material from a segment of the rod, by grinding, in an off-centered manner, said segment including a junction between the first and second parts, the first transversal dimension of said segment being thereby reduced.

2. The method according to claim 1, wherein the second part of the applicator head of the application pen has a shape designed for the application of the fluid substance on a body part.

3. The method according to claim 2, wherein the second part of the applicator head has a pointed shape.

4. The method according to claim 3, wherein the porous material of the applicator head is chosen from among a foam, a felt and a fibrous material.

5. The method according to claim 3, wherein the application pen further comprises a container filled with an amount of the fluid substance, an end of the first part of the applicator head being in contact with the fluid substance.

6. The method according to claim 2, wherein the second part of the applicator head of the application pen has a tapered shape.

7. The method according to claim 6, wherein the porous material of the applicator head is chosen from among a foam, a felt and a fibrous material.

8. The method according to claim 6, wherein the application pen further comprises a container filled with an amount of the fluid substance, an end of the first part of the applicator head being in contact with the fluid substance.

9. The method according to claim 6, wherein the fluid substance is a cosmetic composition.

10. The method according to claim 2, wherein the porous material of the applicator head is chosen from among a foam, a felt and a fibrous material.

11. The method according to claim 2, wherein the application pen further comprises a container filled with an amount of the fluid substance, an end of the first part of the applicator head being in contact with the fluid substance.

12. The method according to claim 1, wherein the porous material of the applicator head is chosen from among a foam, a felt and a fibrous material.

13. The method according to claim 12, wherein the application pen further comprises a container filled with an amount of the fluid substance, an end of the first part of the applicator head being in contact with the fluid substance.

14. The method according to claim 1, wherein the application pen further comprises a container filled with an amount of the fluid substance, an end of the first part of the applicator head being in contact with the fluid substance.

15. The method according to claim 14, wherein the application pen further comprises a longitudinal body extending parallel to the first axis, the applicator head being attached to an end of the longitudinal body, said longitudinal body encasing or being attached to the container.

16. The method according to claim 15, wherein the fluid substance is a cosmetic composition.

17. The method according to claim 14, wherein the fluid substance is a cosmetic composition.

18. The method according to claim 1, wherein the rod of porous material is formed through the following steps:

forming elongated rods by hot shaping, out of original yarns; then impregnating the elongated rods by a resin, then drying and curing said elongated rods; then cutting the elongated rods to an appropriate length.

19. The method according to claim 1, including a further step of inserting the application head into a longitudinal body encasing a container filled with fluid substance.

* * * * *